US007737918B2

(12) United States Patent
Jeong

(10) Patent No.: US 7,737,918 B2
(45) Date of Patent: Jun. 15, 2010

(54) METHOD FOR CONTROLLING ADDRESS POWER ON PLASMA DISPLAY PANEL AND APPARATUS THEREOF

(75) Inventor: Jae-Seok Jeong, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 1308 days.

(21) Appl. No.: 10/930,944

(22) Filed: Sep. 1, 2004

(65) Prior Publication Data

US 2005/0057448 A1 Mar. 17, 2005

(30) Foreign Application Priority Data

Sep. 2, 2003 (KR) ..... 10-2003-0061179

(51) Int. Cl.
*G09G 3/28* (2006.01)

(52) U.S. Cl. ..... 345/63

(58) Field of Classification Search ..... 345/60–72; 313/581–604; 315/169.4
See application file for complete search history.

(56) References Cited

U.S. PATENT DOCUMENTS 6,331,843 B1 * 12/2001 Kasahara et al. ..... 345/63
2002/0036610 A1 3/2002 Ito et al.
2003/0058194 A1 3/2003 Kang
2005/0082957 A1 * 4/2005 Hoppenbrouwers et al. .... 313/3

FOREIGN PATENT DOCUMENTS

| | | |
|---|---|---|
| CN | 1246952 | 3/2000 |
| CN | 1338093 | 2/2002 |
| CN | 1425175 | 6/2003 |
| JP | 11-161218 | 6/1999 |
| JP | 2000-066638 | 3/2000 |
| JP | 2003-140596 | 5/2003 |
| KR | 1020020032927 A | 4/2002 |
| KR | 10-2002-0032927 | 5/2002 |
| KR | 1020040107188 A | 12/2004 |

* cited by examiner

*Primary Examiner*—Bipin Shalwala
*Assistant Examiner*—Steven E Holton
(74) *Attorney, Agent, or Firm*—H.C. Park & Associates, PLC

(57) ABSTRACT

A method for controlling address power consumption on a PDP is disclosed. Image data to be displayed on the PDP are converted into subfield data, and the subfield data are analyzed to generate a variation value of the data for each subfield. An address power recovery circuit operates or ceases operating in one or more subfields based on the variation value of the data associated with each subfield. Image data is determined to be a normal mode or a specific mode based on the generated variation value of the image data, and the number of the subfields displayed on the PDP during the specific mode is set to be less than the number of subfields displayed during the normal mode.

14 Claims, 8 Drawing Sheets

DOt on/off (a)

Full White (b)

| SF1 | SF2 | SF3 | SF4 | SF5 | SF6 |
|---|---|---|---|---|---|
| APE>Th_apf | APE>Th_apf | APE>Th_apf | APE>Th_apf | APE>Th_apf | APE>Th_apf |
| Power Recovery Operation | Power Recovery Operation | Power Recovery Operation | Power Recovery Operation | Power Recovery Stop | Power Recovery Stop |

METHOD FOR CONTROLLING ADDRESS POWER ON PLASMA DISPLAY PANEL AND APPARATUS THEREOF

CROSS REFERENCE TO RELATED APPLICATION

This application claims priority to Korean Patent Application No. 2003-61179 filed on Sep. 2, 2003 in the Korean Intellectual Property Office, the disclosure of which is herein incorporated by reference.

BACKGROUND OF THE INVENTION

1. Field of the Invention

The present invention relates to plasma display panels generally. More specifically, the present invention relates to an apparatus and method for controlling address power on a plasma display panel.

2. Description of the Related Art

A plasma display panel (PDP) includes a plurality of discharge cells arranged in a matrix format on a substrate. Images are displayed by selectively emitting various combinations of discharge cells. In this manner, video data input as electric signals is restored as an image that a user can see.

Color PDPs require shades of gray (gray scales) in order to present vibrant color pictures. Gray scales are provided by dividing the display into a plurality of subfields and controlling them in a time-varying manner.

For example, in the subfield method, each subfield is time-divided into a reset period for resetting a full screen, an address period for scanning the full screen in a line scanning manner and for programming data, as well as a sustain period for maintaining an emission state of the cells to which the data is programmed.

At least one address electrode is provided for performing an address operation. Similarly, at least one scan electrode is provided for performing a scan operation. Additionally, at least one common electrode is provided for performing a sustain operation. When the address electrode is driven in the PDP to display images, about 10 W to 500 W of power is consumed depending on resolution and size of the PDP. Conventionally, an address power recovery circuit is used to control the address power consumption. As described, power consumption of the displayed images with steeply increased address power consumption is controlled to some degree by using the address power recovery circuit. However, when an image without increased address power consumption is displayed, the address power recovery circuit continues to operate, and power consumption increases as a side effect.

The published Korean Patent Application No. 2002-32927 (A Method for Driving an Address Electrode of a Plasma Display Panel) discloses the side effect caused by a displayed image when the address power recovery circuit is operated. In this case, when a variation value of the input image data is less than a reference value, operation of the address power recovery circuit ceases. When the variation value exceeds the reference value, the address power recovery circuit operates to reduce the address power consumption. However in the above-noted application, only the variation value of the input image data is generated, and therefore, the address power recovery circuit stops operating for all subfields when the variation value is small, and operates when the variation value of the data is large. Accordingly, this and prior PDP systems control address power consumption ineffectively because the address data varies for each subfield, and the characteristics of the address power consumption differs for each subfield used to provide gray scales in a PDP.

Also, the higher the PDP's resolution and the wider its panel area become, the more the power is consumed when the address electrode is driven. Thus, it is difficult to control the power consumption using only the address power recovery circuit. A solution is needed that provides an improved apparatus and method for efficiently controlling address power consumption in a PDP.

SUMMARY OF THE INVENTION

In one embodiment, the present invention provides a method and apparatus for analyzing images to be displayed on a Plasma Display Panel (PDP) in order to control an address power recovery operation for each subfield.

In one embodiment of the invention, a method for controlling the address power on the PDP using the address power recovery circuit includes a) converting image data to be displayed on the plasma display panel into subfield data; b) analyzing the converted subfield data to generate a variation value of the image data; and c) controlling the number of the subfields for displaying the image data when the generated variation value of the image data is greater than a first predetermined threshold value.

Additionally, the number of subfields used to display the image data when the variation value of the generated image data is greater than the first threshold value is determined to be less than the number of subfields for displaying the image data when the variation value of the generated image data is less than the first threshold value.

In one embodiment, step b includes analyzing the converted subfield data to generate the variation value for each subfield and adding the generated variation value for each subfield to all subfields to generate the variation value of the image data.

In another embodiment of the present invention, an apparatus for controlling address power on a plasma display panel, includes a data variation value calculator that converts image data to be displayed on the plasma display panel into corresponding subfield data and analyzes them to generate the variation value of the image data. Also included is a mode determine unit that first compares the variation value of the image data generated by the data variation value calculator to a first predetermined threshold value and then generates number control signals to the subfields for displaying the image data. A subfield number determine unit determines the number of the subfields based on the signals generated by the mode determine unit. An address data controller converts the image data into the corresponding subfield data that is used to drive the plasma display panel (the subfield data is converted according to the number of the subfields determined by the subfield number determine unit). Additionally, the address data controller generates address data rearranged to correspond to address timing for each subfield. An address electrode driver generates pulses for address discharging based on the address data received from the address data controller. A driving controller generates subfields that correspond to the number of the subfields determined by the subfield number determine unit and provides them to the plasma display panel.

In another embodiment, the apparatus for controlling address power on plasma display panel includes an address power recovery operation determine unit that determines the operational status of the address power recovery circuit for each subfield when the variation value of the data for each subfield generated by the data variation value calculator is compared with a second predetermined threshold value. An address power recovery timing controller manages the switch timing of the address power recovery circuit based on the operational status of the address power recovery circuit determined by the address power recovery operation determine unit. Additionally, the address electrode driver drives the address power recovery circuit using the switch timing generated by the address power recovery timing controller.

The address power recovery operation ensures unit that the address power recovery circuit 1) stops operating when the variation value of the data for each subfield is less than the second predetermined threshold value, and 2) operates when the variation value of the data for each subfield is greater than the second predetermined threshold value.

The subfield number determine unit further includes a first subfield number data storage that stores the number data of the subfields when the variation value of the image data is greater than the first predetermined threshold value. Also included is a first subfield number data storage that stores the number data of the subfields when the variation value of the image data is less than the first predetermined threshold value. A selector selects data from either the first subfield number data storage and the second subfield number data storage based on the signals received from the mode determine unit.

BRIEF DESCRIPTION OF THE DRAWINGS

The accompanying drawings, which are incorporated in and constitute a part of the specification, illustrate an embodiment of the invention, and, together with the description, serve to explain the principles of the invention.

FIG. 4 (*b*) is a diagram that illustrates a full white image to which less address pulse switching is applied.

DETAILED DESCRIPTION OF THE PREFERRED EMBODIMENTS

Figure 1:
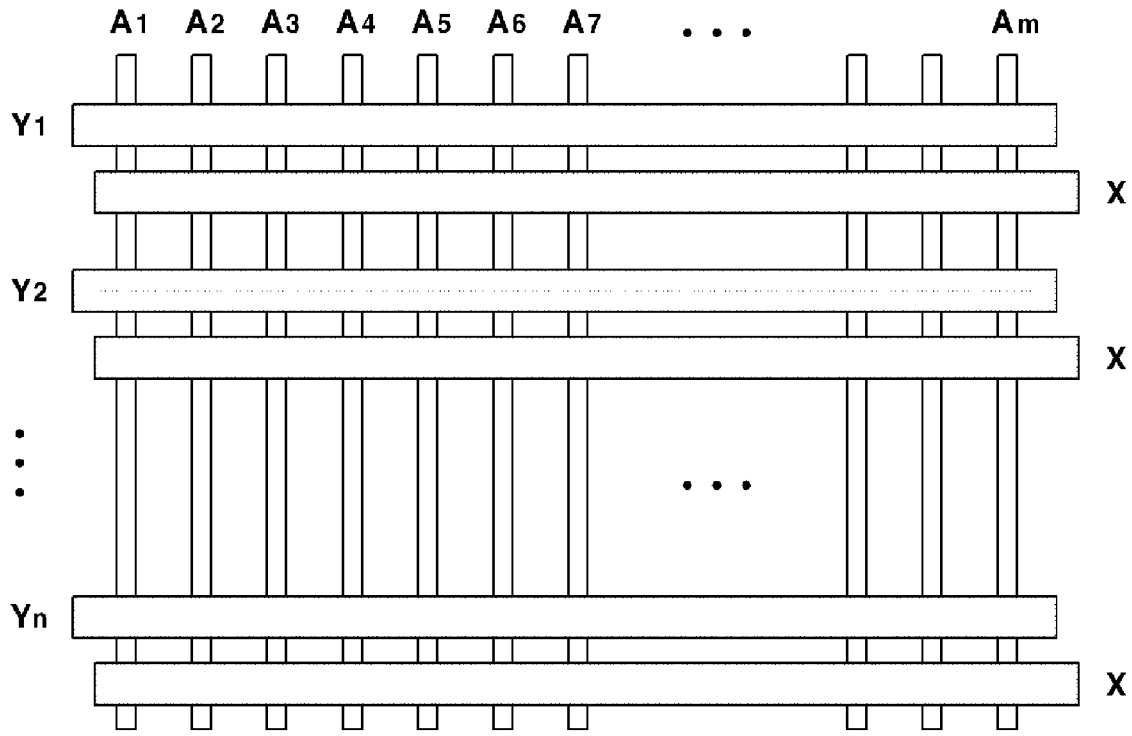
FIG. 1 is a general diagram that represents a PDP (plasma display panel) having a conventional tri-electrode structure.

FIG. 1 is a diagram that illustrates a structure of a plasma display panel (PDP) having a conventional tri-electrode structure.

As shown in FIG. 1, the PDP of the tri-electrode structure includes scan electrodes ($Y_1$, $Y_2$, . . . , and $Y_n$) for a scan function, a common electrode (X) for a sustain function, and address electrodes ($A_1$, $A_2$, . . . , $A_m$) for an address function. The scan electrodes ($Y_1$, $Y_2$, . . . , and $Y_n$) and the common electrode (X) are arranged parallel on the front substrate of the PDP, and the address electrodes ($A_1$, $A_2$, . . . , $A_m$) are arranged crossing the scan electrodes ($Y_1$, $Y_2$, . . . , and $Y_n$) and the common electrode (X) on the rear substrate of the PDP.

Figure 2:
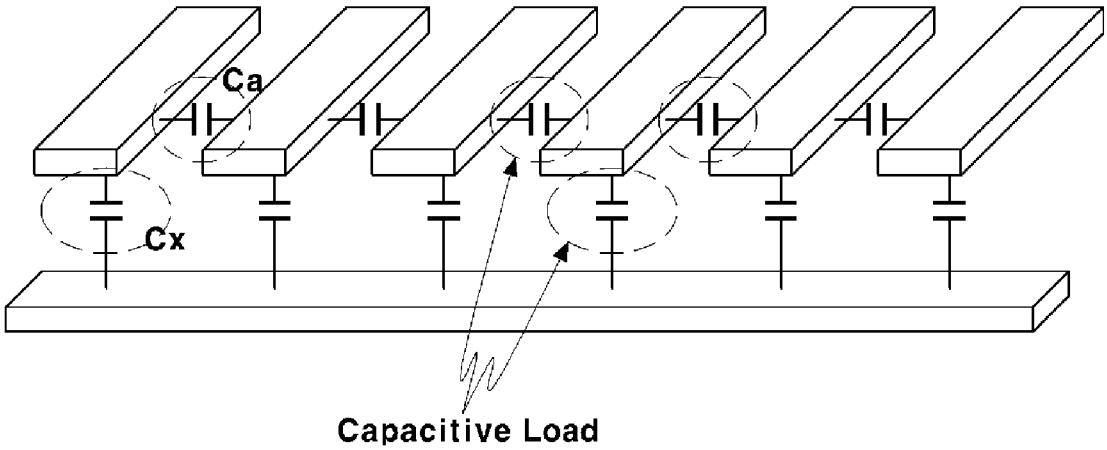
FIG. 2 is a diagram that represents a capacitive component of a panel around address electrodes in a conventional PDP having the tri-electrode structure.

FIG. 2 is a diagram that illustrates a capacitive component of a panel around address electrodes arranged in a conventional PDP of a tri-electrode structure. As shown, the capacitive component of the panel includes capacitive components ($C_x$) between address electrodes and scan electrodes and between address electrodes and common electrodes, and capacitive components (Ca) between the address electrodes.

In this instance, the capacitive component ($C_x$) is defined to be the sum of a capacitive component ($C_{a_x}$) between an address electrode and a common electrode, and a capacitive component ($C_{a_y}$) between an address electrode and a scan electrode.

In the PDP, an address pulse switching operation is generated based on display image data, and reactive power consumption is generated by charging/discharging the capacitive components ($C_x$, $C_a$) of the panel based on the address pulse switching operation. The reactive power consumption is represented as $C \times V^2$, where V is the voltage provided to the PDP, and C is the total capacitive component. The address power consumption varies according to the kinds of images displayed.

Figure 3:
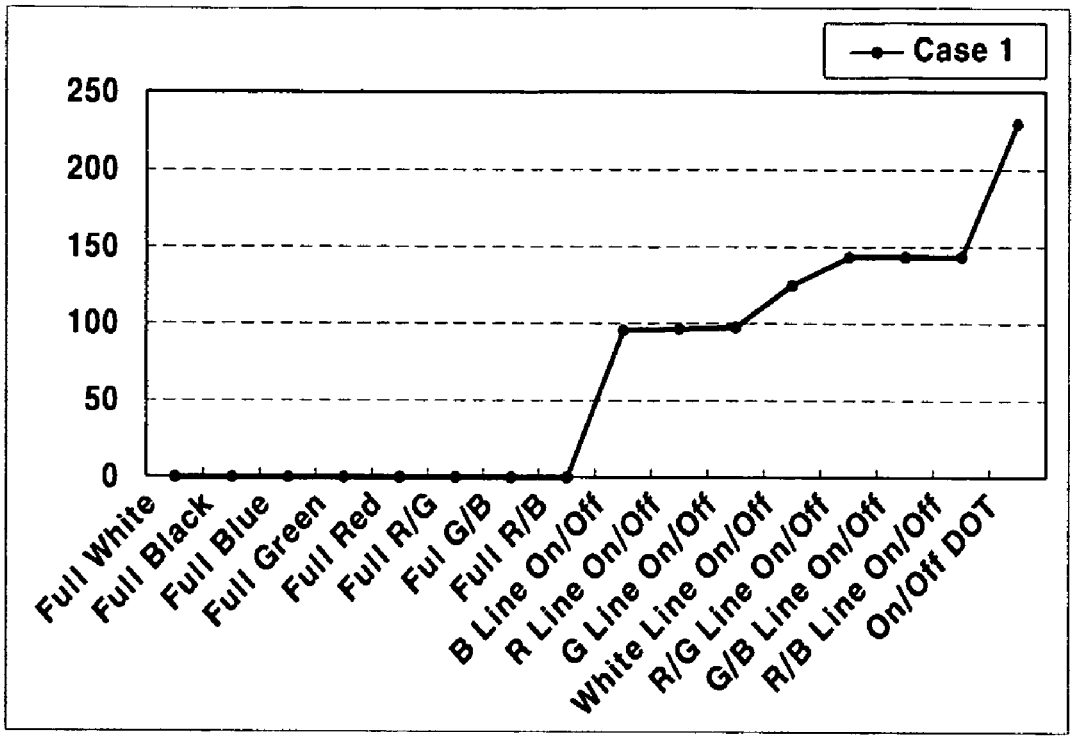
FIG. 3 is a graph that represents characteristics of address power consumed as images are displayed and the address power recovery circuit is not operated.
Figure 4:
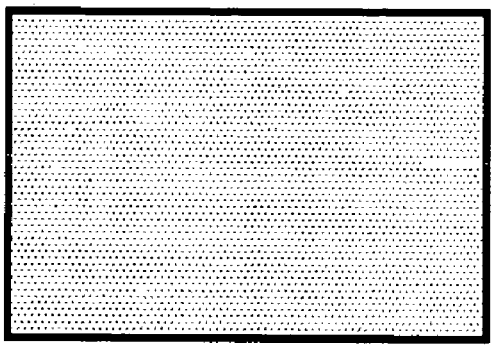
FIG. 4 (*a*) is a diagram that represents a dot ON/OFF image to which a lot of address pulse switching is applied.
Figure 4:
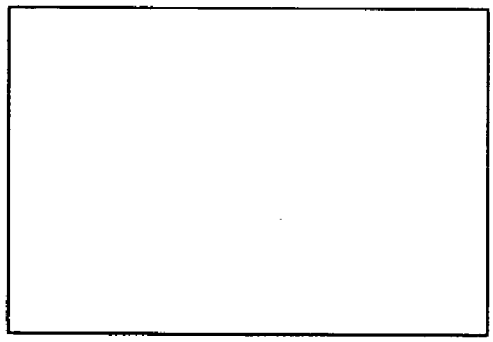

FIG. 3 is a graph that illustrates characteristics of address power consumed by displayed images when the address power recovery circuit does not operate. As shown in FIG. 3, when displaying an image using fewer address pulse switching operations, for example, when displaying a full white image as shown in FIG. 4 (*b*), address power consumption is very low. When displaying an image with many address pulse switching operations, for example, when displaying an image in the dot ON/OFF as shown in FIG. 4 (*a*), the address power consumption is substantially increased.

In the dot ON/OFF image shown in FIG. 4 (*a*), the address power consumption is steeply increased because many variations are generated between up and down adjacent lines, and right and left adjacent cells. These variations create plural switching operations, which increases address power consumption. In the full white image as shown in FIG. 4 (*b*), fewer switching operations are generated because it requires fewer variations between up and down adjacent lines and right and left adjacent cells. Consequently, the address power consumption is low.

When the address power consumption is high the load of an address driving IC is increased and the generation of heat rapidly increases. In this case, the generation of excess heat destroys the IC and degrades product reliability. Consequently, an address power recovery circuit is used in order to prevent the problems. However, as shown in FIG. 3, the address power consumption of the display image in which the address power consumption is rapidly increasing is controlled to some degree when the address power recovery circuit is used, but when an image without increased address power consumption is displayed, the address power recovery circuit continues to operate. As a result, the power consumption tends to increase instead of decrease.

Therefore, in an improvement over the conventional methods, an exemplary embodiment of the present invention analyzes images to be displayed on the PDP and images in which the address power consumption of the PDP does not increase, such as movies and dramas. Similarly, PC images are determined to be images in the normal mode, and dot ON/OFF images and line ON/OFF images in which the address power consumption of the PDP is rapidly increased are determined to be images in a specific mode and are differently controlled.

For display images determined to be images in normal mode, the address power recovery circuit operates only in individual subfields which require address power recovery, as indicated by an Address Power Factor (APF) value generated for each subfield. The address power recovery circuit stops operating in the subfields which need no address power recovery.

For display images determined to be images in specific mode, the address power recovery circuit operates based on the APF value generated for each subfield to control the address power consumption. Additionally, the number of subfields for displaying images in specific mode is set to a number less than the number of the subfields for displaying the images in the normal mode. Because fewer subfields are used, power consumption decreases even for an image displayed in specific mode.

The APF is provided for each subfield, and is defined to be the sum of the capacitive components of the panel provided on the address electrodes, that is, the capacitive component ($C_x$) between the address electrode and the scan electrode/the common electrode, and the capacitive component (Ca) between the address electrodes as shown in [Equation 1].

$$APF=C_x+C_a \quad \text{[Equation 1]}$$

Once the APF is generated for each subfield, it serves as a reference for determining a generational status of the address power recovery circuit of each subfield. That is, the address power recovery circuit operates and controls the subfields where APF is greater than a predetermined threshold value TH_apf. The address power recovery circuit stops operating and controlling subfields whose APF is less than the predetermined threshold value TH_apf.

As shown in [Equation 2], the total sum of the APFs generated for the respective subfields is defined to be the Address Power Factor Total (APFT), and is used as a reference for determining whether images to be displayed on the PDP are the images in the normal mode or in the specific mode.

$$APFT = \sum_{SF=1}^{N} APF(SF) \quad \text{[Equation 2]}$$

where SF represents the subfield and N represents the number of the subfields. That is, the display image data is determined to be in the specific mode when the APFT is greater than a predetermined threshold value TH_apft. The display image data is determined to be in the normal mode when the APFT is less than the predetermined threshold value TH_apft.

A method for generating the capacitance, Cx, and the capacitance, $C_a$, which are components of the APF, will be described.

First, $C_x$ represents the sum of the capacitive components ($C_{a_x}$) between the address electrodes and the common electrodes, and the capacitive components ($C_{a_y}$) between the address electrodes and the scan electrodes. In one embodiment, a method for comparing the display data between the up and down lines of the display images converted to the subfield data is used in order to generate the Cx.

Figure 5:
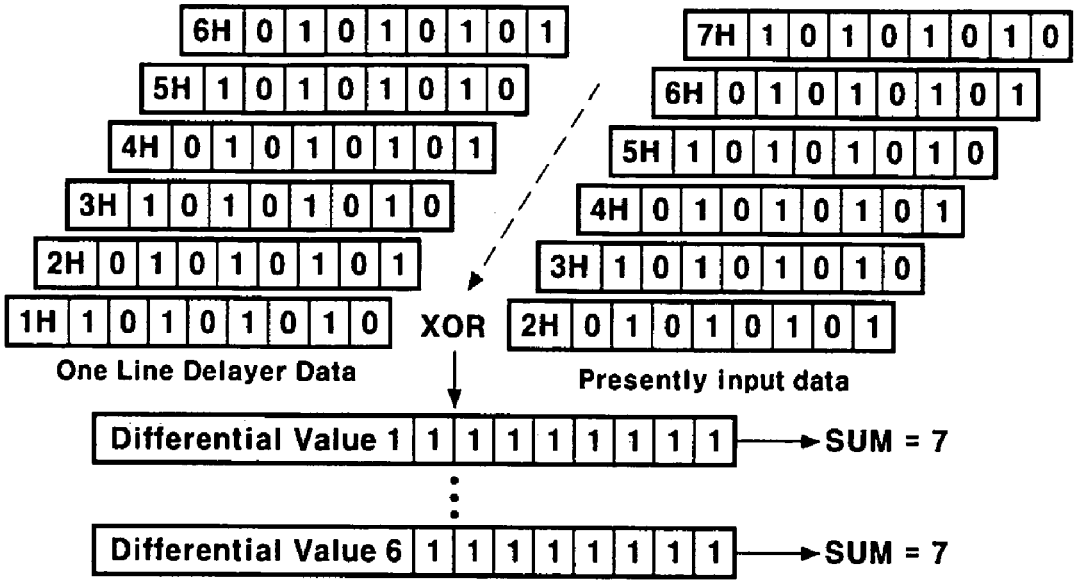
FIG. 5 is a diagram that illustrates analyzing data between upper and lower lines, and calculating a capacitance, Cx, in a method for controlling the address power on the PDP, according to an exemplary embodiment of the invention.

With reference to FIG. 5, data corresponding to one horizontal line is delayed for a period for displaying one horizontal line (generally one horizontal synchronous period, that is, one $H_{sync}$, period), and each differential value generated when the delayed data are compared with current input horizontal line data by each cell is added to generate a variation value between two lines.

As described above, the sum of the differential values generated for each horizontal line represents $C_x$, when the differential value of each line to be displayed on a screen of the PDP is repeatedly added by N−1 number of times, wherein N is the number of display lines. Illustratively, $C_x$ corresponding to a subfield is given as a differential value of R, G, B (red, green, and blue) of each pixel as shown in [Equation 3].

$$\text{Cx_sf} = \sum_i \sum_j +|(R_{ij} - R_{(i+1)j}|+|G_{ij} - G_{(i+1)j}| + |B_{ij} - B_{(i+1)j}|). \quad \text{[Equation 3]}$$

In [Equation 3], a subtraction operation or an Exclusive OR(XOR) operation can also be used.

$C_a$ represents a capacitive component between the address electrodes. In one embodiment, a method for comparing the data between right and left adjacent cells from among the horizontal line data converted to the subfield data is used in order to generate the capacitive component $C_a$.

Figure 6:
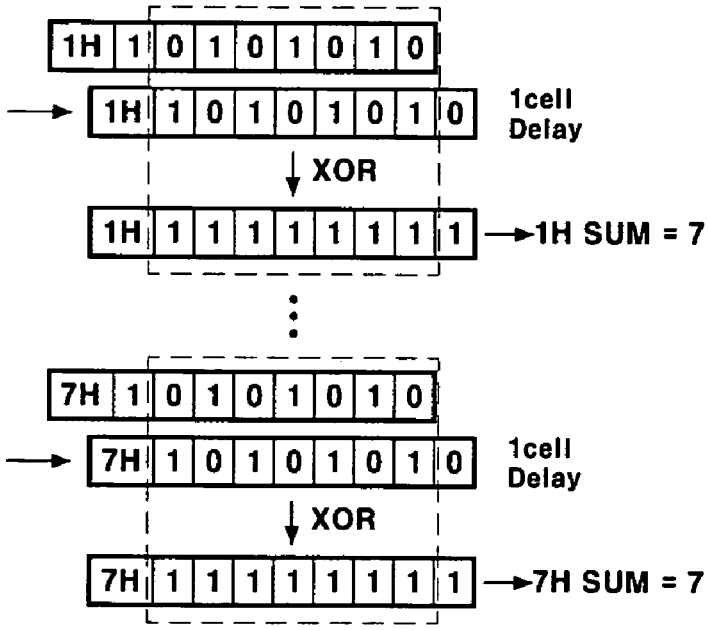
FIG. 6 is a diagram that illustrates analyzing data between right and left adjacent cells, and of calculating a capacitance, Ca, in the method for controlling the address power on the PDP, according to an exemplary embodiment of the invention.

As shown in FIG. 6, data corresponding to one horizontal line are delayed for a period of one cell and compared with original data, and the generated differential values are then added.

Thus, capacitive component Ca represents the total sum of the differential values for the respective lines displayed on a PDP screen by repeatedly adding them N number of times, where N represents the number of display lines. Illustratively, the subtraction operation or the XOR operation is used to generate the differential values.

The display data is compared while generating the capacitive components $C_x$ and $C_a$. Because the display data is data converted to the subfield data, the status of display data for each cell has either a status of '0' or '1'. The status of '0' represents the OFF status of discharge cells, and the status of '1' represents the ON status of the discharge cells.

As shown, the APF of each subfield is generated by summing the capacitive components $C_x$ and $C_a$ generated for each subfield. The APF generated for each subfield is established to be a reference for determining whether to operate or stop the address power recovery circuit for each subfield. For example, as shown in FIG. 7, when the APF of a subfield is greater than a predetermined threshold value (TH_apf), the address power recovery circuit operates to control the first to fourth subfields (SF1, SF2, SF3, SF4), and when the APF is less than the predetermined threshold value (TH_apf), the address power recovery circuit does not operate for the fifth to sixth subfields (SF5, SF6).

Figures 7, 8:
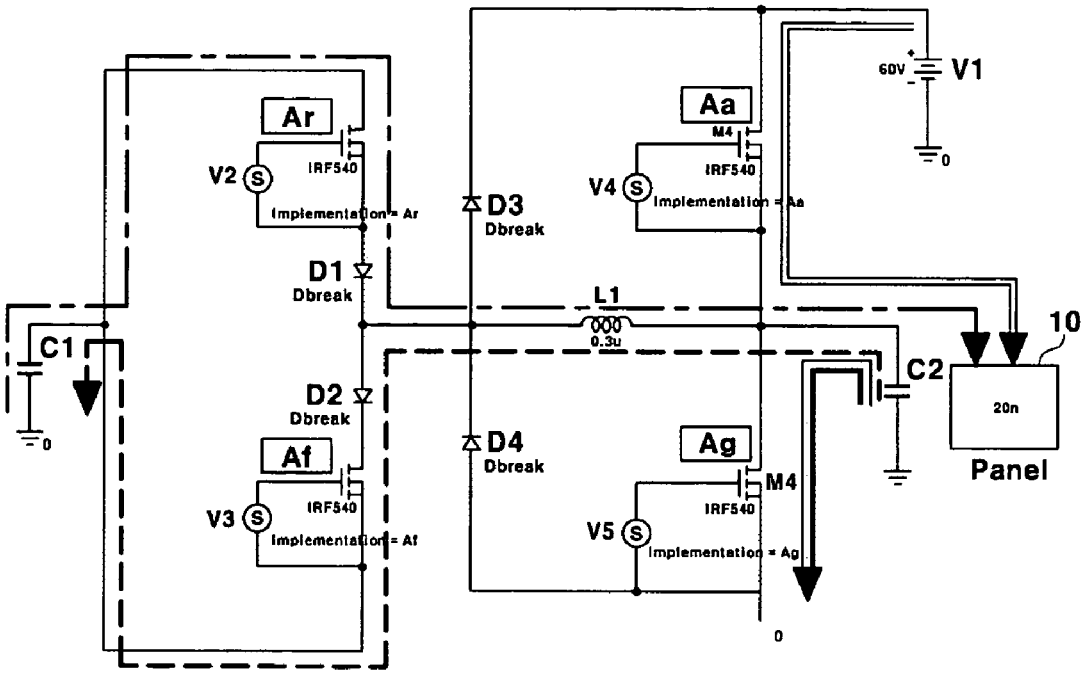
FIG. 7 is a table that illustrates a status of operation and stoppage of the address power recovery circuit according to the size of APF (Address Power Factor) in a method for controlling the address power on the PDP according to one embodiment of the invention.
FIG. 8 is a diagram that illustrates an address electrode driving circuit of the conventional PDP.

FIG. 8 is a diagram illustrating an improved address electrode driving circuit for use in a conventional PDP. As shown, an address electrode driving circuit includes an address power recovery circuit having a first Field Effect Transistor (FET) ($A_r$), a second FET ($A_f$), a first capacitor ($C_1$), a first diode ($D_1$), a second diode ($D_2$), a signal source (V2) for providing a signal to the first FET ($A_r$) and a signal source ($V_3$) for providing a signal to the second FET ($A_f$). Additionally included are an address driver having a third FET ($A_a$), a fourth FET($A_g$), a third diode ($D_3$), a fourth diode ($D_4$), a second capacitor ($C_2$) having a first terminal that represents the address electrode of the PDP Panel 10, a power source ($V_1$) for providing power to the third FET ($A_a$), a signal source ($V_4$) for providing a signal to the third FET ($A_a$), and a signal source ($V_5$) for providing a signal to the fourth FET ($A_g$).

Figure 9:
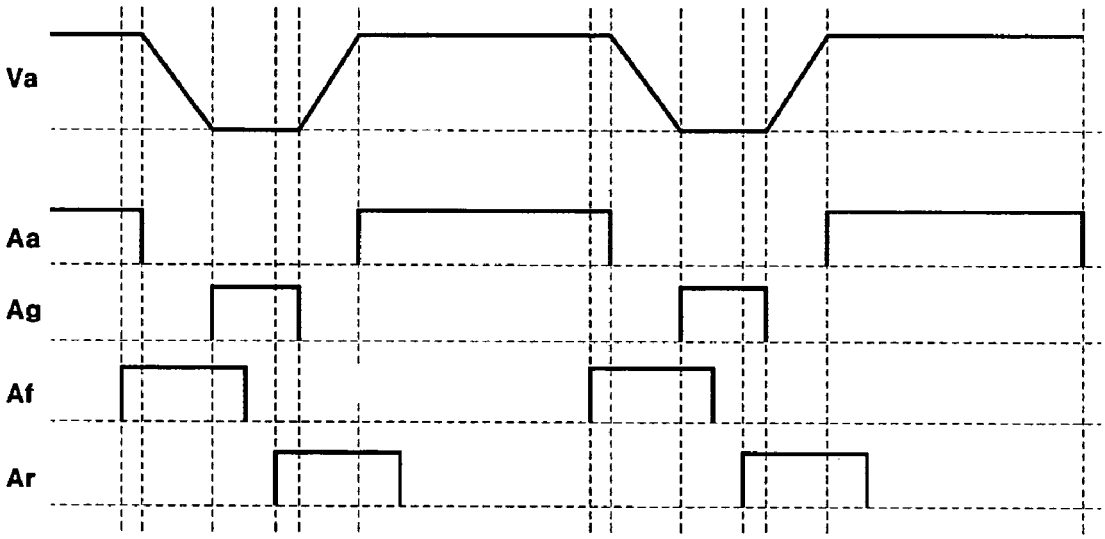
FIG. 9 is a chart that illustrates switch timing when the address power recovery circuit is operated according to an exemplary embodiment of the invention.
Figure 10:
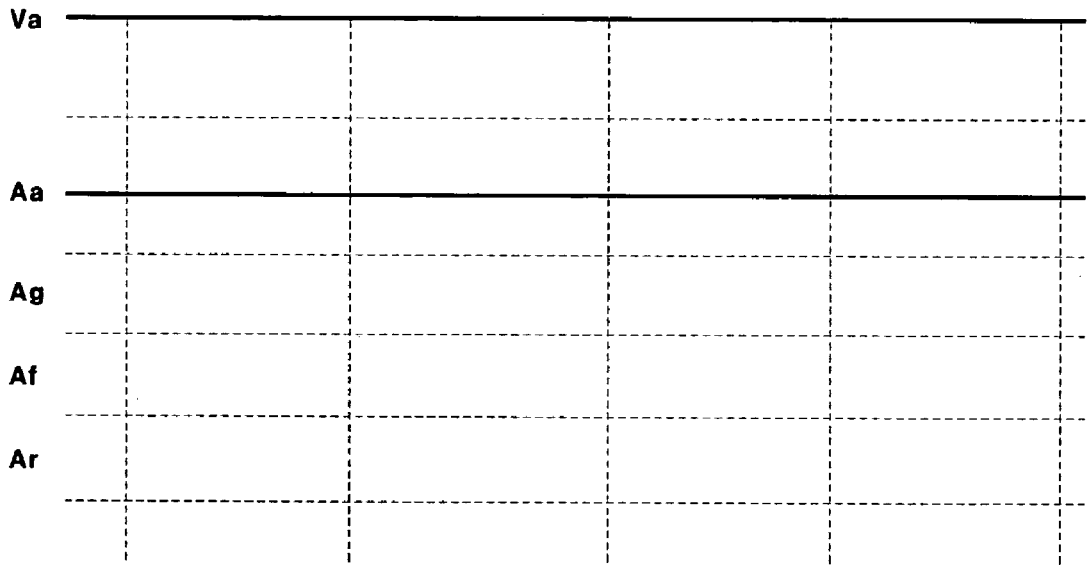
FIG. 10 is a chart that illustrates switch timing when the operation of the address power recovery circuit is stopped according to an exemplary embodiment of the present invention.

The APF generated for each subfield determines an operational status of the address power recovery circuit of the address electrode driving circuit. The address power recovery circuit is operated according to switch timing as shown in FIG. 9 when the generated APF is greater than the threshold value (TH_apf) of the APF, and is operated according to switch timing as shown in FIG. 10 when the generated APF is less than the threshold value (TH_apf) of the APF.

Operation of the address electrode driving circuit having an address power recovery circuit is now described with reference to FIG. 9. When the signal source ($V_2$) outputs a high signal to the first FET ($A_r$), and the first FET ($A_r$) is turned on, the capacitor ($C_1$) (charged by a discharge of the PDP panel 10) discharges a charged power, and the power level of the panel 10, especially, the level of the power ($V_a$) applied to the address electrode, increases.

The signal source ($V_4$) outputs a high signal when the level of the power ($V_a$) reaches a predetermined degree to turn on the third FET ($A_a$) and provides the address power to the panel 10. This increases the power ($V_a$) to a predetermined degree, and maintains the status for a determined time.

The signal source ($V_4$) outputs a low signal to turn off the third FET ($A_a$), and the signal source ($V_3$) outputs a high signal to turn on the second FET ($A_f$), to charge capacitor ($C_1$) with the power discharged from the panel 10.

When the capacitor ($C_1$) is charged, the signal source ($V_5$) outputs a high signal to turn on the fourth FET ($A_g$) and stops providing power to the panel 10.

The address electrode driving operation and the address power recovery operation are performed by repeating the steps described above.

As shown in FIG. 10, no signals are provided to the first FET ($A_r$), the second FET ($A_f$) and the fourth FET ($A_g$) for charging and discharging the address driving voltage together with the address power recovery circuit. A high signal is provided to the first FET ($A_a$) used for driving the panel 10 to turn on the first FET ($A_a$) so that the predetermined level of the voltage ($V_a$) may be supplied to the panel 10. In other words, the address power recovery circuit ceases operation.

Figure 11:
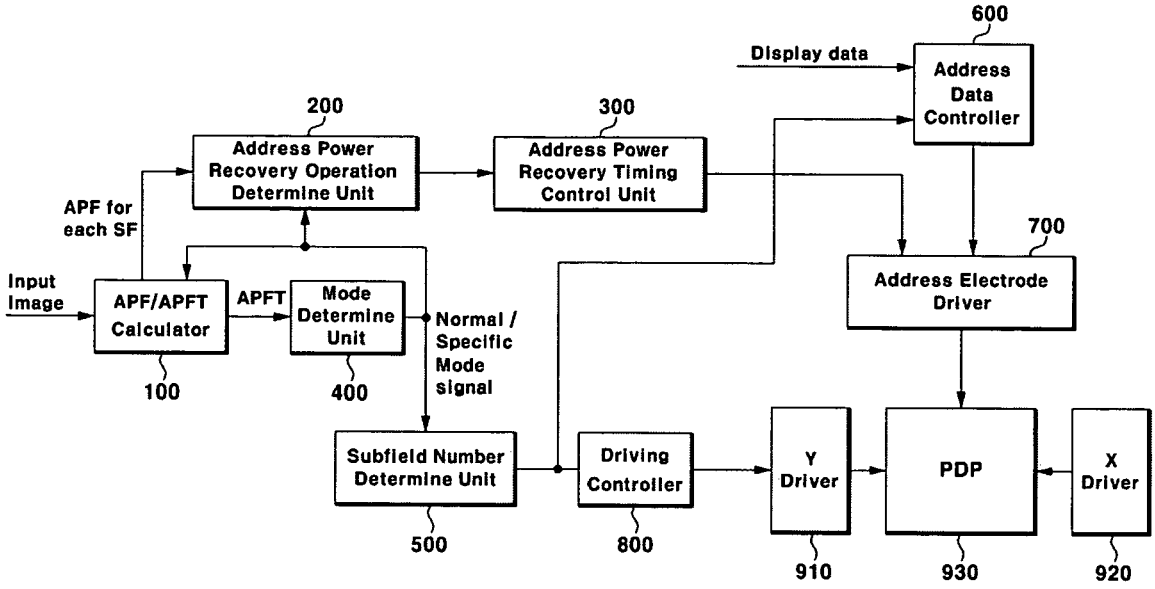
FIG. 11 is a block diagram that illustrates an address power controller of the PDP according to an exemplary embodiment of the invention.

FIG. 11 is a block diagram for an address power controller of the PDP according to an exemplary embodiment of the invention. As shown, a PDP address power controller according to an exemplary embodiment of the present invention includes an APF/APFT calculator 100, an address power recovery operation determine unit 200, an address power recovery timing control unit 300, a mode determine unit 400, a subfield number determine unit 500, an address data controller 600, an address electrode driver 700, and a driving controller 800.

The APF/APFT calculator 100 receives image data and converts the data to subfield data, generates capacitive components $C_x$ and $C_a$ of the address electrodes for each subfield, adds them to calculate APF for each subfield, and adds the APF for each subfield to calculate the APFT.

The address power recovery operation determine unit 200 receives APF for each subfield calculated by the APF/APFT calculator 100 and compares them to the threshold value TH_apf of the APF to determine whether the address power recovery circuit is operated or stopped.

The address power recovery timing control unit 300 generates switch timing as shown in FIG. 9 or FIG. 10 based on operation or non-operation of the address power recovery circuit as determined by the address power recovery operation determine unit 200.

The mode determine unit 400 receives the APFT generated by the APF/APFT calculator 100 and determines whether images to be displayed are images in the normal mode or in the specific mode and outputs a signal (mode) representing the determination results. At this time, the mode determine unit 400 outputs a Mode 1 signal in the normal mode and Mode 2 signal in the specific mode.

Based on the signal output from the mode determine unit 400, the subfield number determine unit 500 determines the subfield number data for the normal mode and the subfield number data for the specific mode, and outputs them. At this time, the subfield number data in the specific mode may be determined to be less than those in the normal mode, as shown in Equation 4.

$$N_s<N_n \text{[Equation 4]}$$

Where $N_s$ is the number of the subfields in specific mode, and $N_n$ is the number of subfields in normal mode.

The address data controller 600 converts the input display data into the subfield data to be fit for driving the PDP and outputs rearranged address data for addressing the timing for each subfield. Thus, the display data are converted into subfield data that corresponds to the number of subfields for the normal mode. Additionally, the address data is rearranged for the address timing for each subfield and are converted into subfield data that corresponds to the number of subfields for the specific mode.

The address electrode driver 700 drives the address power recovery circuit based on the signal output from the address power recovery timing control unit 300, and generates pulses for discharging the address based on the address data output from the address data controller 600 to provide the pulses to the PDP 930.

The driving controller 800 receives signals from the mode determine unit 400 and generates subfields that correspond to the number of the subfields for the display in the normal mode, and also generates subfields that correspond to the number of subfields for the display in specific mode. In one embodiment, the number of subfields generated in specific mode is less than the number of subfields generated in normal mode.

The Y driver 910 generates pulses for driving the scan electrode (Y) and provides the pulses to the PDP 930 to be corresponded to the generated subfields by the driving controller 800. X driver 920 generates pulses for driving the common electrode (X) and provides the pulses to the PDP 930.

Figure 12:
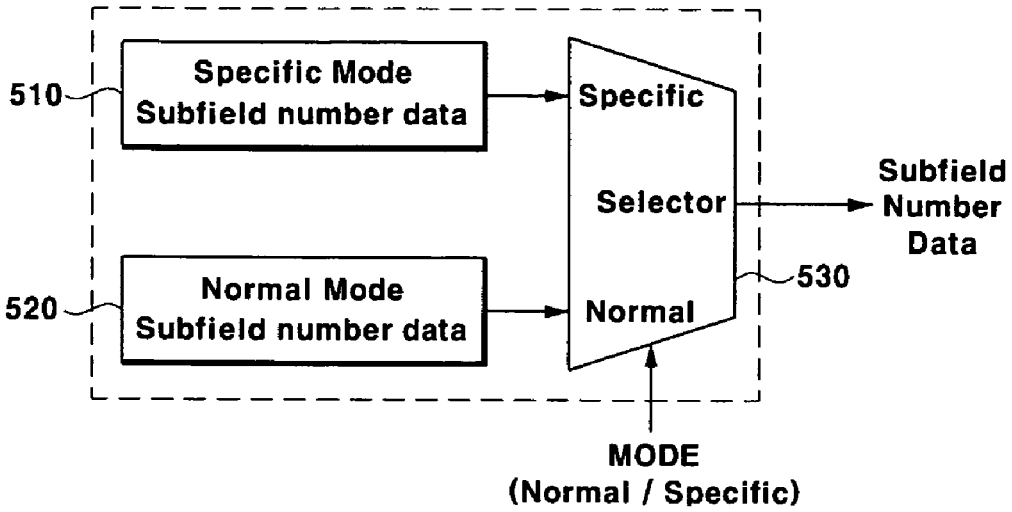
FIG. 12 is a detailed block diagram that illustrates a subfield number data determine unit in FIG. 11.

FIG. 12 shows a detailed block diagram for a subfield number determine unit 500 shown in FIG. 11.

As shown in FIG. 12, the subfield number determine unit 500 includes a specific mode subfield number data storage 510, a normal mode subfield number data storage 520, and a selector 530.

The specific mode subfield number data storage 510 stores subfield number data for displaying images in the specific mode.

The normal mode subfield number data storage 520 stores subfield number data for displaying images in the normal mode.

For gray scales of equal value, the subfield number data stored in the normal mode subfield number data storage 520 is established to be greater than the subfield number data stored in the specific mode subfield number data storage 510.

The selector 530 selects between the subfield number data output from the specific mode subfield data storage 510 and the subfield number data output from the normal mode subfield number data storage 520 depending on the signal output by the mode determine unit 400.

In general, the address power consumption increases in proportion to the number of subfields used because an address period which consumes power is assigned for each subfield.

As shown, the reason why fewer numbers of subfields are used to display images in the specific mode than those in the normal mode is that the address power consumed in the address period of each subfield is proportional to total number of the subfields. Because fewer subfields are used, the address power consumption is reduced. Also, since the display image in specific mode is not usually controlled by the number of gray scales, the number of the gray scales displayed may be less than the number used in normal mode.

Figure 13:
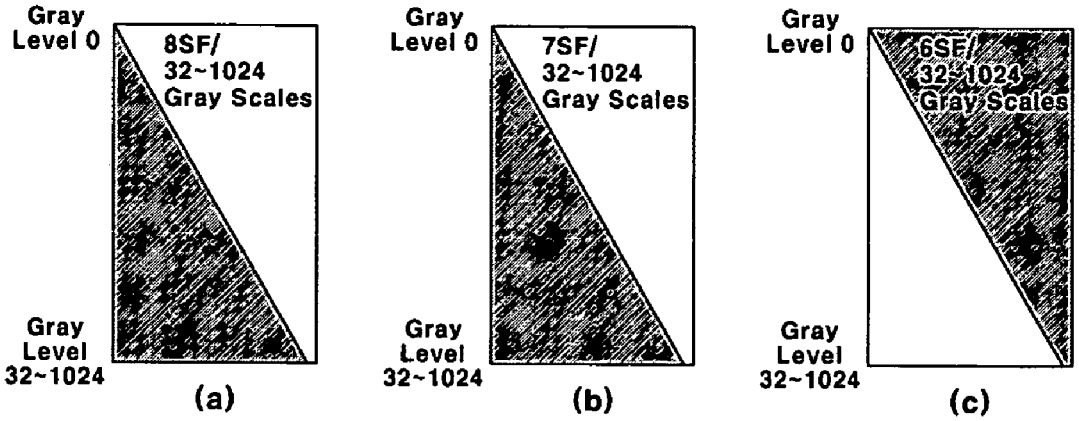
FIG. 13 is a diagram that illustrates an example of a subfield structure and gray scales used in a specific mode in an apparatus for controlling the address power on the PDP, according to an exemplary embodiment of the invention.
Figure 14:
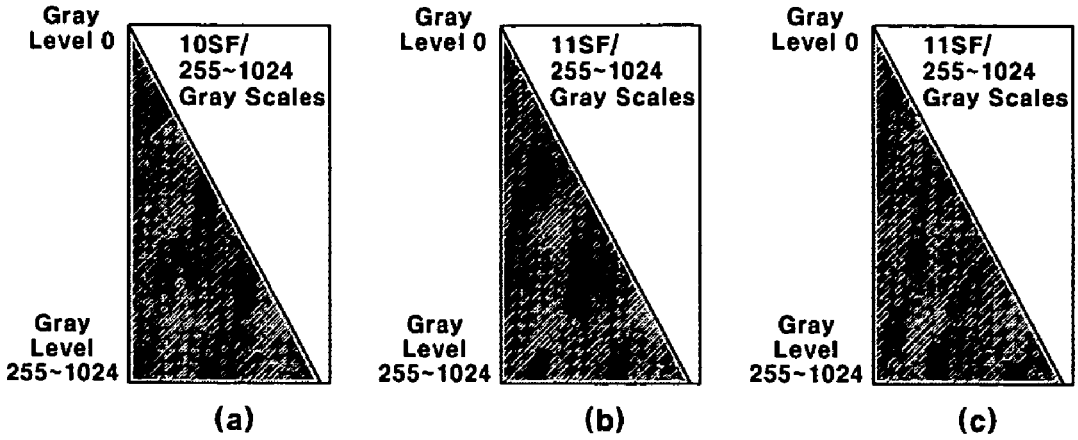
FIG. 14 is a diagram that illustrates an example of a subfield structure and gray scales used in a normal mode in an apparatus for controlling the address power on the PDP according to an exemplary embodiment of the present invention.

FIG. 13 is a diagram illustrating an example of a subfield structure and gray scales in the specific mode in the method for controlling the PDP address power according to an exemplary embodiment of the present invention. FIG. 14 is a diagram illustrating an example of the subfield structure and gray scales in normal mode.

As shown in FIG. 13, six to eight subfields are used to represent 32 gray scales to 1024 gray scales in the case of the specific mode, but ten to twelve subfields, which are more than the specific mode, are used to represent 255 gray scales to 1024 gray scales in the normal mode. However, the invention is not limited to the above exemplary embodiments, but is intended to cover various modifications from three to nine subfields. Additionally, it is preferable that over ten subfields and 255 gray scales are used in the normal mode.

Figure 15:
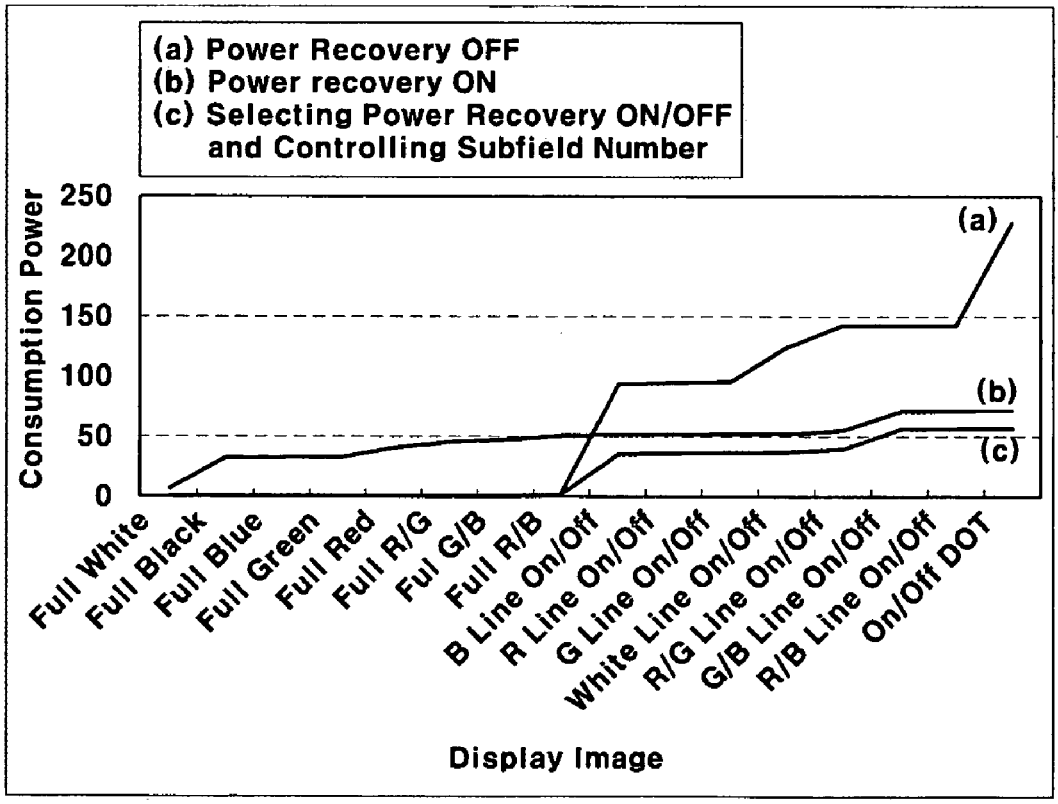
FIG. 15 is a graph that illustrates characteristics of address power consumption; (a) when the conventional address power recovery circuit does not operate; (b) when the conventional address power recovery circuit continues to operate; and (c) an address power recovery circuit selects operation of each subfield and controls the number of subfields, according to an exemplary embodiment of the present invention.

FIG. 15 is a graph that illustrates characteristics of address power consumption; (a) when a conventional address power recovery circuit is not operated; (b) when the conventional address power recovery circuit continues to be operated; and (c) when an address power recovery circuit is selectively operated in each subfield and the number of subfields is controlled according to an exemplary embodiment of the invention. As shown in FIG. 15 (*a*), the address power consumption of the image having fewer address pulse switching operations is very low, and the address power consumption of images with many address pulse switching operations is greatly increased.

As shown in FIG. 15 (*b*), the address power consumption is reduced in images to which a lot of address pulse switching operations are applied in comparison with (a), but is increased in the images to which less address pulse switching operations are applied in comparison with (a) when the address power recovery circuit is operated.

As shown in FIG. 15 (*c*), when the address power recovery circuit is selectively operated for each subfield and the number of the subfields is controlled in the specific mode, the address power consumption is very low compared to (a) and (b), because the address power recovery circuit is stopped for the images with less address pulse switching operations, and a number of subfields is controlled to be less than the normal mode, even though the address power recovery circuit operates for images to which a lot of address pulse switching operations are applied. Therefore, the method according to the exemplary embodiment of the present invention most effectively controls the address power consumption.

While the invention has been described in connection with what is presently considered to be practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A method for controlling address power of a plasma display panel having an address power recovery circuit, the method comprising:

converting image data to be displayed on the plasma display panel into corresponding subfield data;

analyzing the converted subfield data to generate a variation value of the image data; and controlling a number of subfields for displaying the image data if the generated variation value of the image data is greater than a first threshold value, wherein the variation value represents an address power factor total (APFT), the APFT comprising a sum of summed capacitive components on a plurality of address electrodes provided on the plasma display panel for all subfields of the converted subfield data, and wherein controlling a number of subfields comprises:

storing first subfield number data if the variation value of the image data is greater than the first threshold value;

storing second subfield number data if the variation value of the image data is less than the first threshold value; and selecting the first subfield number data or the second subfield number data to be the number of subfields based on the variation value.

2. The method of claim 1, wherein the number of subfields for displaying the image data when the variation value of the generated image data is greater than the first threshold value is less than the number of subfields for displaying the image data when the variation value of the generated image data is less than the first threshold value.

3. The method of claim 1, wherein analyzing the converted subfield data further comprises:

analyzing the converted subfield data to generate a variation value for each subfield; and adding the generated variation value for each subfield together for all subfields to generate the variation value of the image data.

4. The method of claim 3, wherein the variation value for each subfield represents an address power factor (APF) for each subfield, and the APFT comprises the sum of the APF for all subfields of the converted subfield data.

5. The method of claim 4, wherein the APF comprises the variation value of converted subfield data between up and down horizontal lines in images displayed on the PDP.

6. The method of claim 4, wherein the APF comprises the variation value of converted subfield data between right and left adjacent cells in images displayed on the PDP.

7. The method of claim 1, wherein the summed capacitive component on a first address electrode represents the sum of capacitive components between the first address electrode and a scan electrode and between the first address electrode and a common electrode provided on the plasma display panel, and a capacitive component between the first address electrode and a second address electrode.

8. The method of claim 3, further comprising:

stopping the operation of the address power recovery circuit for one or more subfields having a generated variation value for each subfield that is less than a second threshold value; and operating the address power recovery circuit for one or more subfields having a generated variation value for each subfield that is greater than the second threshold value.

9. An apparatus for controlling address power on a plasma display panel having an address power recovery circuit, the apparatus comprising:

a data variation value calculator for converting image data to be displayed on the plasma display panel into corresponding subfield data and analyzing the subfield data to generate a variation value of the image data;

a mode determine unit for comparing the variation value generated by the data variation value calculator with a first threshold value to generate control signals for displaying the image data;

a subfield number determine unit for determining a number of subfields based on the control signals generated by the mode determine unit, and for outputting the number of subfields;

an address data controller for converting display data into corresponding subfield data for driving the plasma display panel, and generating address data to correspond to an address timing for each subfield;

an address electrode driver for generating pulses to control address discharges based on the address data received from the address data controller, and for supplying the pulses to the plasma display panel; and a driving controller for generating subfields corresponding to the number of the subfields determined by the subfield number determine unit, and providing the subfields to the plasma display panel, wherein the variation value represents an address power factor total (APFT), the APFT comprising the sum of summed capacitive components on a plurality of address electrodes provided on the plasma display panel for all subfields of the corresponding subfield data converted by the data variation value calculator, and wherein the subfield number determine unit comprises:

a first subfield number data storage unit for storing first subfield number data if the variation value of the image data is greater than the first threshold value;

a second subfield number data storage for storing second subfield number data if the variation value of the image data is less than the first threshold value; and a selector for selecting the first subfield number data or the second subfield number data to be the number of subfields based on the control signals from the mode determine unit.

10. The apparatus of claim 9, wherein the subfield number determine unit determines that the number of the subfields when the variation value of the image data is greater than the first threshold value is less than the number of the subfields when the variation value of the image data is less than the first threshold value.

11. The apparatus of claim 9, wherein the data variation value calculator further analyzes the subfield data and calculates a variation value of the image data for each subfield.

12. The apparatus of claim 11, further comprising;

an address power recovery operation determine unit for comparing the variation value of the image data for each subfield generated by the data variation value calculator with a second threshold value, and determining an operational status of the address power recovery circuit for each subfield; and an address power recovery timing controller for generating switch timing of the address power recovery circuit based on the operational status of the address power recovery circuit, and for outputting the switch timing to the address electrode driver;

wherein the address electrode driver drives the address power recovery circuit using the switch timing generated by the address power recovery timing controller.

13. The apparatus of claim 12, wherein the address power recovery operation determine unit determines that the address power recovery circuit is not operated if the variation value of the image data for each subfield is less than the second threshold value, and that the address power recovery circuit is operated if the variation value of the image data for each subfield is greater than the second threshold value.

14. The apparatus of claim 9, wherein the first subfield number data is less than the second subfield number data for gray scales of equal value.

* * * * *